US006119890A

United States Patent [19]

Kawamata

[11] Patent Number: 6,119,890

[45] Date of Patent: Sep. 19, 2000

[54] METALLIC CAN AND METHOD OF MANUFACTURE OF SAME, AND CAN COVER WITH INTEGRAL SCRAPER

[75] Inventor: Seizi Kawamata, Saitama, Japan

[73] Assignee: Nihon Seikan Kabushiki Kaisha, Saitama, Japan

[21] Appl. No.: 09/079,862

[22] Filed: May 15, 1998

[30] Foreign Application Priority Data

Nov. 27, 1997 [JP] Japan ..... 9-326013
Dec. 5, 1997 [JP] Japan ..... 9-335913

[51] Int. Cl.[7] ..... B65D 25/00

[52] U.S. Cl. ..... 220/695; 220/266; 220/380; 220/654; 220/657; 220/700; 220/780; 220/826; 220/810; 220/837

[58] Field of Search ..... 220/651, 654, 220/657, 810, 820–822, 826, 837, 839, 695, 699–701, 380, 266, 524, 525, 780

[56] References Cited

U.S. PATENT DOCUMENTS

| | | | |
|---|---|---|---|
| 202,429 | 7/1878 | Filed | 220/654 X |
| 1,478,360 | 12/1923 | Thomas . | |
| 1,703,157 | 2/1929 | Lima et al. . | |
| 2,128,953 | 9/1938 | Miller . | |
| 2,433,031 | 12/1947 | Coyle . | |
| 2,870,932 | 1/1959 | Davis | 220/524 X |
| 3,358,875 | 12/1967 | Ekstrom . | |
| 3,412,890 | 11/1968 | Rich . | |
| 3,417,897 | 12/1968 | Johnson . | |
| 3,421,654 | 1/1969 | Hexel . | |
| 4,014,459 | 3/1977 | Robinson . | |
| 4,101,046 | 7/1978 | Puntillo . | |
| 4,611,726 | 9/1986 | Skinnell | 220/524 X |
| 4,881,656 | 11/1989 | Chumley et al. | 220/266 X |
| 5,002,197 | 3/1991 | Ponsi . | |
| 5,064,088 | 11/1991 | Steffes . | |
| 5,423,448 | 6/1995 | Pedigo . | |
| 5,540,349 | 7/1996 | Philips . | |
| 5,875,915 | 3/1999 | Bradshaw . | |
| 5,913,446 | 6/1999 | Von Holdt, Sr. et al. | 220/657 X |

FOREIGN PATENT DOCUMENTS

| | | |
|---|---|---|
| 0 004 075 | 9/1979 | European Pat. Off. . |
| 2 154 624 | 5/1973 | France . |
| 2 192 946 | 2/1974 | France . |
| 2 496 056 | 6/1982 | France . |
| 2 639 561 | 6/1990 | France . |
| 2 738 139 | 5/1997 | France . |
| 36 29 718 | 3/1988 | Germany . |
| 532834 | 9/1939 | United Kingdom . |
| 2 072 131 | 9/1981 | United Kingdom . |
| 95 35245 | 12/1995 | WIPO . |

*Primary Examiner*—Stephen K. Cronin
*Assistant Examiner*—Robin A. Hylton
*Attorney, Agent, or Firm*—Wenderoth, Lind & Ponack, L.L.P.

[57] ABSTRACT

A cylindrical can cover to be mounted onto an opening of the can is disclosed, which includes a top plate and a peripheral wall extending downwardly from the peripheral margin of the top plate. The top plate is divided into two parts, one part being stationary on the opening of the can and including a scraper extending across the top plate and extending downwardly from the underside of the top plate, and the other part being swingable up and down and including a folding line extending along the scraper across the top plate. The peripheral wall includes a sealing band connected at a thinner wall portion and having its bottom end extending laterally, and a detachable part extending vertically at each of positions corresponding to opposite ends of the folding line extending to the peripheral edge of the top plate.

10 Claims, 4 Drawing Sheets

8

9
1
2a 2
1

2
10
1

12a
14
12b
15
12b
12a
11
13
1

1
2
3
1

METALLIC CAN AND METHOD OF MANUFACTURE OF SAME, AND CAN COVER WITH INTEGRAL SCRAPER

BACKGROUND OF THE INVENTION

1. Field of the Invention

The present invention relates generally to a can and a can cover to be mounted on the can. More particularly, it relates to a metallic can including a can shell with an opening on one end or at the top and an annular flange formed as an integral part of the can shell on its inner side wall in the neighborhood of the opening of the can shell for attaching a separator film or foil sheet to the annular flange to seal the can hermetically, and a method of manufacturing such a metallic can. Furthermore, it relates to the construction of a cylindrical can cover having a top plate and a peripheral wall extending downwardly from the peripheral margin of the top plate and adapted to be mounted on the can shell wherein the can cover includes a scraper formed as an integral part of the can cover such that it extends downwardly from the underside of the top plate of the can cover.

2. Description of the Prior Art

The term "scraper" as used herein should be understood to mean any tool that may be used to remove any extra part of the content on a spoon or like by rubbing that part off, when the content is taken out of a can by using the spoon.

There is known a conventional metallic can that has an annular flange on the inner wall side of the can shell in the neighborhood of the opening on one end thereof for attaching a separator film or foil sheet to the annular flange. For the known metallic can, the annular flange is provided separately from the can shell during the can manufacturing process, and is then fitted around the inner side wall of the can shell and secured thereto.

A conventional metallic can may also include a scraper that is used to scrape off or remove any extra part of the content on a spoon or like when the content is taken out of the can using the spoon. In this case, the scraper is also made separately from the can shell during the can manufacturing process, and is offered as an accessory to the finished can product. Thus, the scraper must be attached to the opening of the can shell when it is used to scrape off the contents on the spoon.

One disadvantage of the conventional metallic can is that the annular flange and the can shell are made of a different material and are produced separately from each other. This increases the usage of the material. In particular, the can manufacturing process involves two different steps, i.e., the step of forming an annular flange and the step of attaching it to the can shell formed separately from it. An additional disadvantage, which is associated with the above disadvantage, is that the manufacturing costs for the final metallic can products must be increased.

A further disadvantage is that the scraper and the can body are provided separately from each other. This also increases the usage of the material and involves two different steps during the manufacturing process. In this case, the scraper, which is packaged separately from the finished can product, is offered as an accessory to the can product. For the end user, this raises a time and labor consumption problem when the end user opens the can and scrapes off the content taken out by the spoon or like, because he or she must attach the scraper to the opening of the can.

SUMMARY OF THE INVENTION

In order to eliminate the above-mentioned disadvantages, an object of the present invention is to provide a metallic can that includes an annular flange formed on the inner side wall of a can shell near the opening of the can shell as an integral part thereof by adding the process for forming the annular flange into the manufacturing process of can.

Another object of the present invention is to provide a cylindrical can cover having a top plate and a peripheral wall extending downwardly from peripheral margin of the top plate and adapted to be mounted on the opening of the can shell wherein it includes a scraper formed as an integral part of the can cover such that it extends downwardly from the underside of the top plate.

One aspect of the present invention is to provide a metallic can product that includes an annular flange that is formed on the inner side wall of a can shell near the top opening of the can shell as an integral part thereof.

Another aspect of the present invention is to provide a method of manufacturing a metallic can product, including the steps of reducing the diameter of the area of a formed metallic can shell delimiting an opening on one end thereof by elongating that area outwardly in parallel with the axis of the can shell for thereby providing a reduced-diameter opening, pressing the portion of the can shell wall located near the reduced-diameter opening inwardly toward the center of the can shell for thereby providing an annular projection extending from the inner can shell wall inwardly toward the center of the can shell, and flattening the annular projection by pressing it in the direction parallel with the axis of the can shell for thereby providing the annular flange on the inner can shell wall as an integral part of the can shell.

According to the method of the present invention, an annular flange may be formed as an integral part of a metallic can shell on the portion of its inner side wall located near the top opening, and this formation may be performed as a part of the existing manufacturing process during which a metallic can shell is formed. Thus, such metallic can, including the integral annular flange, may be produced efficiently in a successive manner on the same production line used in the existing manufacturing process. As there is no need of forming the annular flange separately from the can shell as it was done in the prior art, the material may be saved, and the manufacturing cost may be reduced accordingly.

According to the method of the present invention, the area of the can shell delimiting the top opening may be reduced diametrically by elongating that area outwardly in parallel with the axis of the can shell. Thus, the thickness of the area delimiting the opening can remain unchanged, and no deformation such as wrinkles can occur on that area.

For forming the annular flange according to the method of the present invention, an annular projection may be formed by elongating the part of the can shell wall located near the opening by pressing that part inwardly toward the center of the can shell, such that the annular projection extends from the inner side wall inwardly toward the center of the can shell. Therefore, no deformation such as wrinkles can occur on the outer can shell side wall.

Finally, the annular projection may be flattened by applying pressure upon it in the transverse direction. The annular flange thus obtained has a double construction including upper and lower parts formed in a U shape. Thus, it has a highly strong construction.

It may be appreciated that the method according to the present invention, during the manufacturing process, avoids that the area of the can shell delimiting the opening being unnecessarily thickened and any deformation such as wrinkles that would affect the appearance occurring on the outer side wall of the can shell. Rather, the highly strong annular flange can make the opening area sufficiently strong enough to resist any external force. Thus, the method of the present invention allows for the use of any can material that is comparatively thin.

The method according to the present invention may include an additional step of curling the area of the can shell delimiting the reduced-diameter opening in the usual manner known per se, before or after the step of forming the annular projection.

Furthermore, the method according to the present invention may include an additional step of mounting a bottom plate on the area of the can shell delimiting an opening on the other end or bottom in the usual manner also known per se, following the preceding steps described above.

According to the metallic can that may be obtained as described above, it includes the annular flange formed as an integral part of the can shell and extending inwardly from the inner side wall located near the opening. As the annular flange may be formed from the base can material, it can save the material. Despite that, the area of the can shell delimiting the opening can be strengthened, and no deformation such as wrinkles can occur on the outer can shell wall. Thus, a good appearance can be retained.

According to a further aspect of the present invention, a can cover with an integral scraper is also provided. The can cover is adapted to be mounted onto the opening of the can shell, and includes a top plate and a peripheral wall extending downwardly from the peripheral margin of the top plate. The can cover is divided into two parts, one of which is stationary on the opening of the can, including a scraper extending across the top plate and extending downwardly from the underside thereof, and the other part serves as a swingable flap, including a folding line extending along the scraper on the before mentioned one part and extending across the top plate. The peripheral wall includes a thinner wall portion extending horizontally near the intermediate height of the peripheral wall, a sealing band provided under the thinner wall portion and extending horizontally, and two detachable parts extending vertically at each of the positions corresponding to respective ones of the opposite ends of the folding line located on the peripheral edge of the top plate.

The can cover with the integral scraper described above may be used in the following manner. First, the sealing band located on the other part (flap) of the top plate having the folding line may be removed from the peripheral wall at the thinner wall portion. Then, the above peripheral wall may be detached at the detachable parts. This may allow the other part (flap) to be swung up or down along the folding line. When the other part (flap) is swung up or down, the part of the top plate having the scraper remains to be closed on the opening of can. Thus, the content picked up by a spoon or like may be scraped off by means of the scraper provided on that part of the top plate part. This eliminates the need of providing a separate scraper and therefore there is no need of mounting the scraper, which is manufactured separately from the can and can cover, on the opening of the can shell when the can is opened and its content is picked up by the spoon or like.

It may be understood that as the scraper is provided on the one part of the top plate an integral part, while the other part of the top plate having the folding line is swingable up or down along the folding line to thereby open or reclose the opening of the can after the sealing band is removed, and the peripheral wall portion is detached at the detachable parts, it is not necessary to provide a separate scraper and mount it on the opening. accordingly, a reduction that, the cost down can be achieved since it is not necessary to manufacture the scraper separately from the can and can cover.

In other words, if such a separate scraper is provided as an attachment to a finished can product, it must be packaged separately and attached to the can product when it is shipped. For the manufacturer, this would require extra time and labor, and for the end user, this would require extra time and labor as the user must mount the scraper on the opening when he or she uses the can product.

According to the present invention, the above described extra time and labor, which are required due to the separate scraper being used, may be eliminated by the can cover with integral scraper.

In the one part of the can cover, which is stationary on the opening of the can, the top plate of the one part may include one or more projections provided near the peripheral wall and extending downwardly from the underside of the top plate. The projection(s) on the top plate part cooperate with the peripheral wall to hold the area of the can shell delimiting the opening, securing the can cover to that area tightly and firmly. Such projection (s) may also be provided attached to the scraper to strengthen it.

DETAILS OF THE PREFFERED EMBODIMENTS

Several preferred embodiments of the present invention are described below in further detail.

(Embodiment 1)

Figure 1:
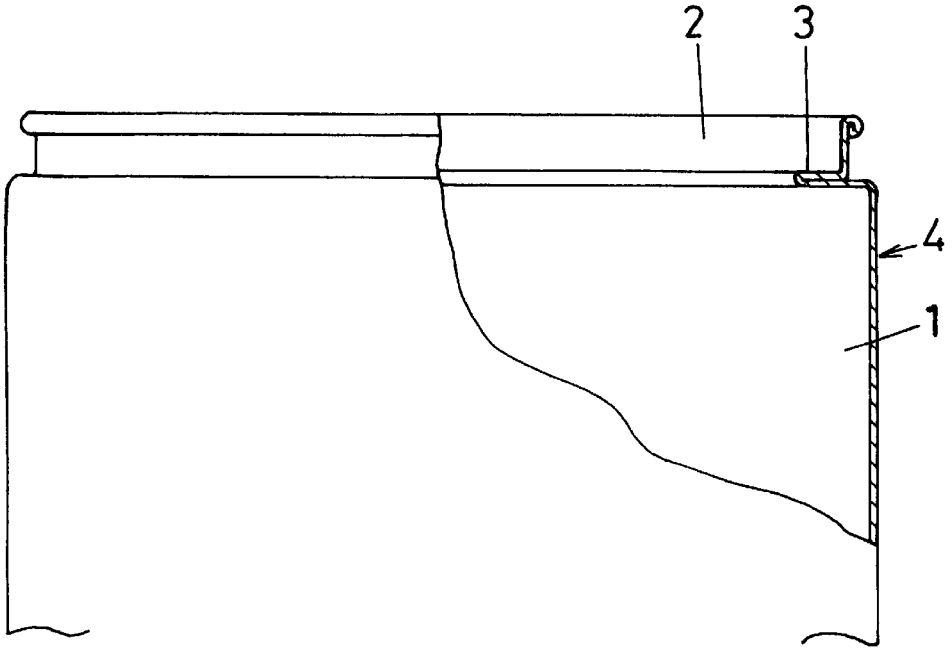
FIG. 1 is a front view of a part of a top opening of metallic can according to a particular preferred embodiment of the present invention, shown as partly broken away and with some parts omitted.
Figure 3:
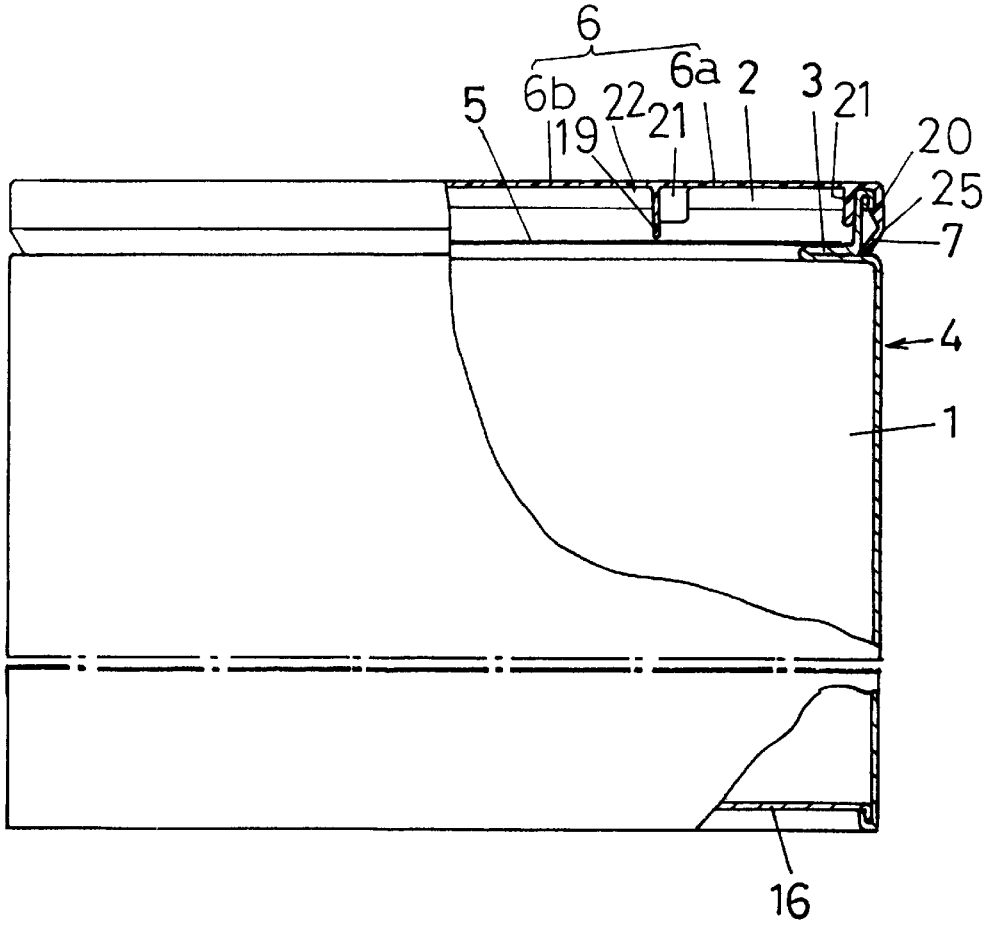
FIG. 3 is a front view illustrating the details of the use of the metallic can according to a particular preferred embodiment of the present invention, shown as partly broken away and with some parts omitted.

A first preferred embodiment of a metallic can according to the present invention is described by referring to FIGS. 1 and 3.

The metallic can, generally shown by 4, includes a can shell 1 having an opening 2 on one end or at the top, and an annular flange 3 that is formed as an integral part of the can shell 1 such that the annular flange 3 extends from the inner wall of the can shell 1 inwardly toward the center of the can shell in the neighborhood of the opening 2.

When the metallic can 4 is used, the can 4 includes a bottom plate 16 on the other end thereof opposite the opening 2, and a separator sheet 5, such as film, foil and the like, covering the opening 2 and having its peripheral margin attached to the annular flange 3 by any adhesive or like. The content is thus hermetically enclosed inside the can shell 1. The opening 2 may be closed by a can cover 6 with integral scraper according to the present invention which will be described later in connection with a third embodiment, or any other conventional can cover. The closure may be performed by pressing the can cover 6 onto the can shell (FIG. 3).

The part designated by 7 in FIG. 3 is a sealing band formed on the lower side of a peripheral wall 20 of the can cover 6. That is to say, a sealing band 7 is formed under the thinner wall portion 25 of the peripheral wall 20. The cover 6 can only be removed from the can shell 1 by detaching the sealing band 7 from the entire can cover 6.

(Embodiment 2)

Figures 2A, 2B, 2C, 2D, 2E, 2F:
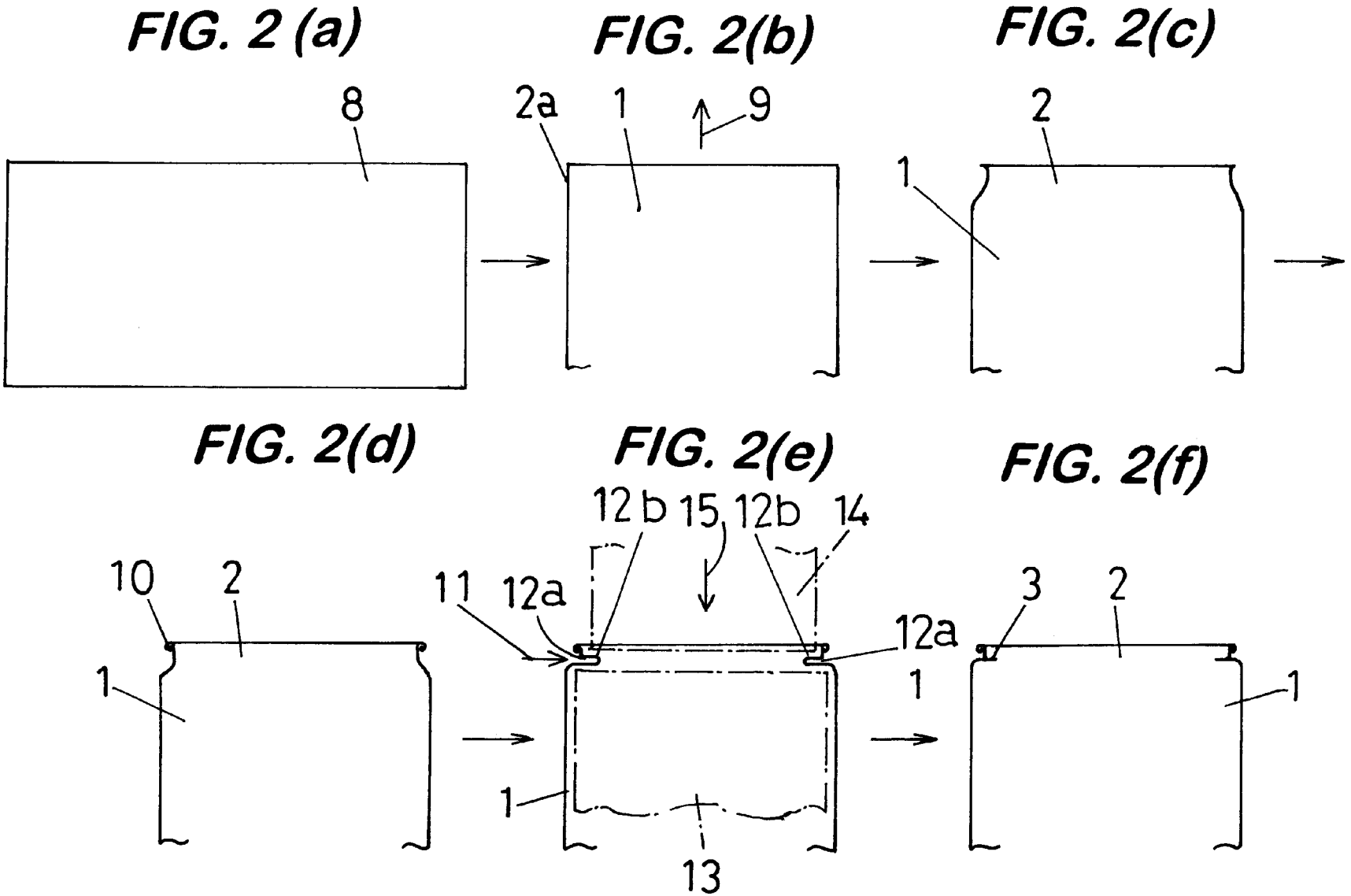
FIG. 2(*a*) to FIG. 2(*f*) are a flow chart illustrating the process of manufacturing a metallic can according to a particular preferred embodiment of the present invention.

The process of manufacturing a metallic can according to an embodiment of the present invention is described by referring to FIG. 2(*a*) through FIG. 2(*f*).

First, a thin blank 8 (FIG. 2(*a*)) for producing a metallic can may be formed into a cylindrical can shell 1 in the usual manner (FIG. 2(*b*)). The peripheral area of the can shell 1 which delimits an opening 2*a* on one end thereof may then be elongated outwardly in parallel with the axis of the can shell, that is, in the direction of an arrow 9 in FIG. 2(*b*). This elongation may occur by reducing the diameter of the opening 2*a* until a reduced-diameter opening 2 can be obtained (FIG. 2(*c*)). Next, a curled portion 10 may be formed by curling the peripheral edge delimiting the opening 2 (FIG. 2(*d*)). Then, the part of the can shell wall located nearer to the opening 2 may be pressed in the direction of an arrow 11, that is, in the direction in which it can be elongated in such a manner as to be pushed from the can shell wall inwardly toward the center of the can shell. An annular U-shape recess 12*a* may thus be formed (FIG. 2(*e*)). When it is viewed from the side of the inner can shell wall, the annular U-shape recess 12*a* is the annular projection 12*b* (FIG. 2(*e*)). Then, the annular projection 12*b* may be sandwiched between an lower mold 13 and an upper mold 14, and may be pressed by the upper mold 14 against the lower mold 13 in the direction of an arrow 15 (FIG. 2(*e*)). An annular flange 3 may thus be obtained as an integral part of the inner can shell wall (FIG. 2(*f*)). In this way, a metallic can 4 may be completed (FIG. 2(*f*)).

As seen from FIG. 2(*a*) to FIG. 2(*f*), the annular flange 3 is formed in a double construction having upper and lower parts pressed tightly in a U shape.

The step of curling the peripheral margin 10 as described above may be performed following the step of forming the annular flange 3.

Following the above described steps, if it is requested, a bottom plate 16 may be mounted to the bottom opening on the side opposite the side on which the opening 2 is provided, and this mounting may be performed in the conventional, usual manner. A can shell may be now finished.

Usually, the metallic can 4 obtained as described above may be used as follows. The peripheral margin of the separator film 5 (for example, aluminum foil) may be attached to the annular flange 3 of the metallic can 4 by adhesive or like. The separator film 5 covers the opening 2 of the can shell, sealing it or the content therein hermetically as shown in FIG. 3. Then, a cover 6 with integral scraper 19 which will be described later in connection with the third embodiment, or any other conventional cover may be mounted onto the opening 2 by pressing the cover upon the opening 2. A set of a can 4 with the separator film 5 attached to the annular flange 3, a cover 6 mounted on the can 4 and a bottom plate 16 is offered to the commercial market. A user of this set may use a metallic can 4 by putting a content into the can shell through the bottom open side opposite the opening 2, mounting the bottom plate 16 onto the bottom open end by curling, and keeping the content hermetic as shown in FIG. 3.

(Embodiment 3)

A preferred embodiment of a can cover with integral scraper according to the present invention is now described by referring to FIGS. 4 through 7.

A can cover 6 equipped with an integral scraper according to the present invention is formed to a cylindrical shape from any suitable soft synthetic resin material, and comprises a top plate 18 and a peripheral wall 20 extending downwardly from the peripheral margin of the top plate 18. The can cover 6 is to be mounted on the opening 2 of the can shell.

Figure 4:
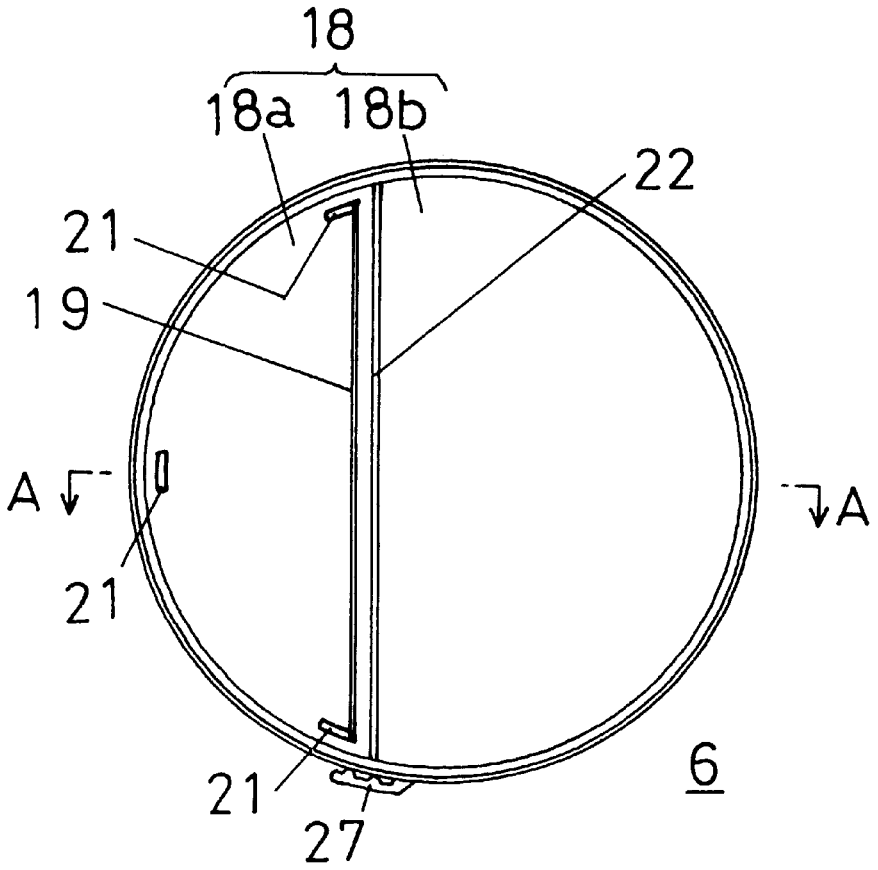
FIG. 4 is a bottom view illustrating a can cover with an integral scraper according to a particular preferred embodiment of the present invention.

A scraper 19 is provided on the top plate 18 such that it extends downwardly from the underside of the top plate 18 (FIG. 4). In the particular embodiment shown in FIG. 4, the scraper 19 is located along straight line off the center line across the top plate 18, but it may be located closer to or farther from the center line as long as it provides the function of the scraper. As a variation of the scraper, it may be provided so that both or either of its opposite ends stop away from the peripheral wall 20 of the can cover 6, instead of providing it across the entire top plate 18 such that either or both of the opposite ends reach the peripheral wall 20.

Figure 5:
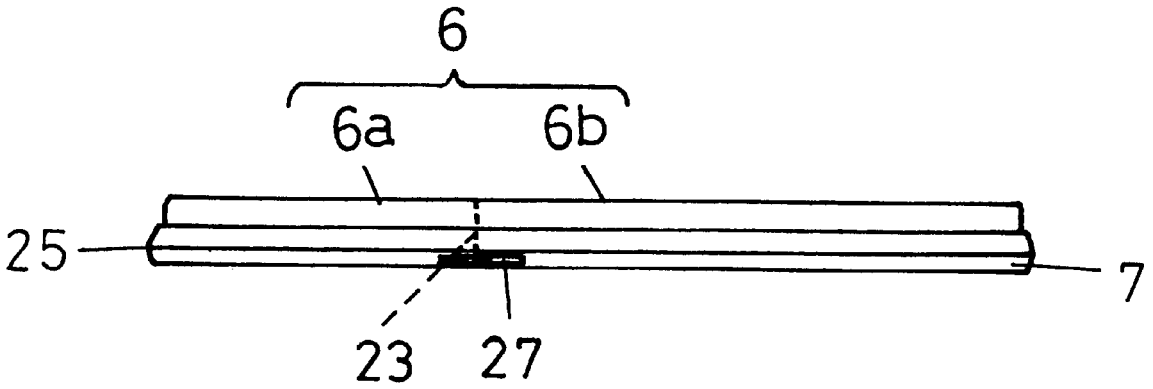
FIG. 5 is an enlarged side view of the can cover with the integral scraper as shown in FIG. 4.

As shown in FIG. 5, the cover 6 has two parts divided by the scraper 19. For the convenience of the following description, the smaller area part occupied by the scraper 19 is referred to as the "cover portion 6*a*", and the remaining larger area part is referred to as the "cover portion 6*b*". As shown in FIG. 4, the top plate 18 also has two parts divided by the scraper 19. Similarly, the smaller area part occupied by the scraper 19 is referred to as the "top plate portion 18*a*", and the remaining larger area part is referred to as the "top plate portion 18*b*".

Figure 6:
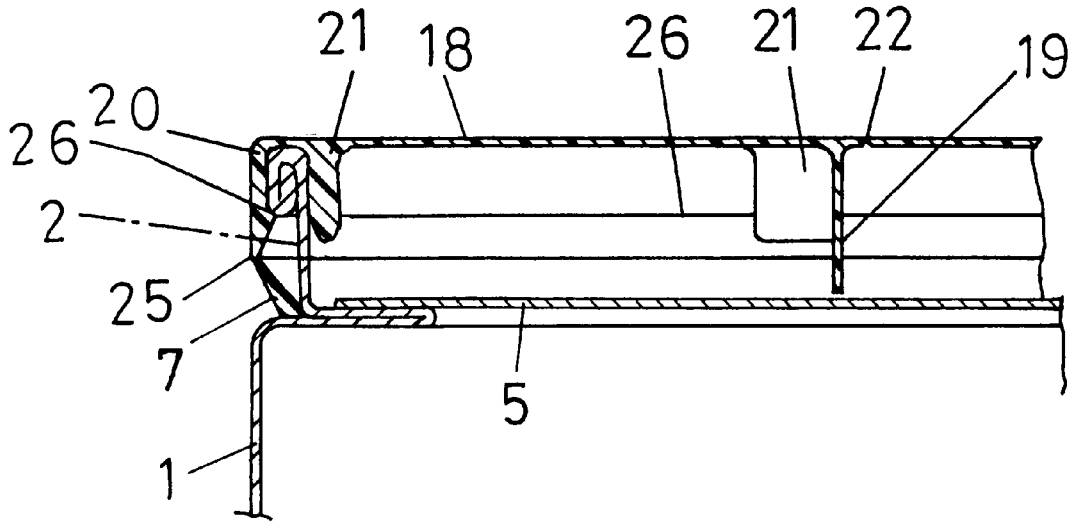
FIG. 6 is an enlarged sectional view of the can cover with the integral scraper, taken along line A—A in FIG. 4.

The peripheral wall 20 has an annular projection 26 extending inwardly from its inner wall side which may engage the corresponding part of the outer wall of the can shell located below the curled portion 10 defining the opening 2 (FIG. 6). Below the annular projection 26, there is a sealing band 7 which is attached to the peripheral wall 20 via its thinner wall portion 25 (FIG. 6).

In the embodiment described here, a projection 21 is provided near the peripheral wall of the top plate portion 18*a*, and extends downwardly from the underside of the top plate portion 18*a* (FIGS. 4 and 6). The projection 21 cooperates with the annular projection 26 of the peripheral wall 20 for holding the area defining the opening 2 there between, thereby securing the can cover 6 to the can shell 1 more tightly, reliably and firmly. There is also a projection 21 which is provided on the lateral side of the scraper 19 (FIG. 4). This projection 21 serves not only to secure the can cover 6 to the can shell 1 tightly and firmly but also to strengthen the scraper 19. Any number of projections 21 may be provided if such projections may serve the above purpose. Preferably, such projections 21 may be provided at three different locations as shown in FIG. 4. The projection may have any other shape, such as an elongated projection.

It should be noted that the projection 21 may be omitted since the annular projection 26 on the peripheral wall 20 can by itself secure the can cover 6 tightly and firmly to the can shell by engaging the outer wall below the curled portion 10 delimiting the opening 2 of the can, as described above.

The top plate portion 18*b* has a folding line 22 extending along the scraper 19 across the top plate 18 (FIG. 4). The folding line 22 allows the cover portion 6*b* to be swung along it while the cover portion 6*a* remains to be mounted on the can shell. The swinging of the cover portion 6*b* up or down opens or closes the opening 2 on the can shell. The folding line 22 may have different forms. For example, a groove may be provided on the underside of the top plate portion 18*b* across the top plate 18.

The portions of the peripheral will 20 that correspond to respective opposite ends of the folding line 22 on the top plate portion 18*b* include weakened parts 23, 23, as frangible areas of detachment such as for example, elongated grooves, that begin with the upper end of the peripheral wall 20, extending vertically to the thinner wall portion 25 (FIG. 5). Such weakened parts 23 may be provided at two locations on the peripheral wall 20, each of which corresponds to respective ones of the opposite ends of the folding line 22. At least one of the weakened parts 23 may go past the thinner wall portion 25 and through the sealing band 7, extending to the lower end of the peripheral wall 20. On the end of the sealing band 7 on the cover portion 6*b* where the weakened part 23 extends to the lower end of the peripheral wall 20, there is a finger catcher 27 that may be used to remove the sealing band 7 from the peripheral wall 20 along the thinner wall portion 25 (FIGS. 4 and 5).

The can cover 6 equipped with the integral scraper 19 that has been described so far may be formed from any known suitable synthetic resin material, including the scraper 19 that may be formed from the same material as an integral part of the can cover 6.

Now, the use of the can cover 6 with the integral scraper 19 according to the present invention is described below.

With the can cover 6 with the integral scraper 19 mounted on the opening 2 on the can shell, the finger catcher 27 is first removed from the peripheral wall 20 at the thinner wall portion 25. If another weakened part 23, which is provided on the side opposite the side on which the finger catcher 27 is provided, extends to the lower end of the peripheral wall 20, this action only removes part of the sealing band 7 located on the cover portion 6*b*, but if the other weakened part 23, which is provided on the side opposite the side on which the figure catcher 27 is provided, extends to the thinner wall portion 25, the action removes the whole sealing band 7 around the entire can cover 6. When only the part of the sealing band 7 on the cover portion 6*b* is removed, the cover portion 6*a*, including both the annular projection 26 and the part of sealing band 7 thereon, remains to be mounted on the opening 2 on the can shell, so that it is quite difficult to remove the cover 6 from the can shell. Whether the can cover 6 is designed to allow the whole sealing band 7 to be removed or only to allow the part of the sealing band 7 on the cover portion 6*b* to be removed may be determined as appropriate, depending upon the usage of the can.

Figure 7:
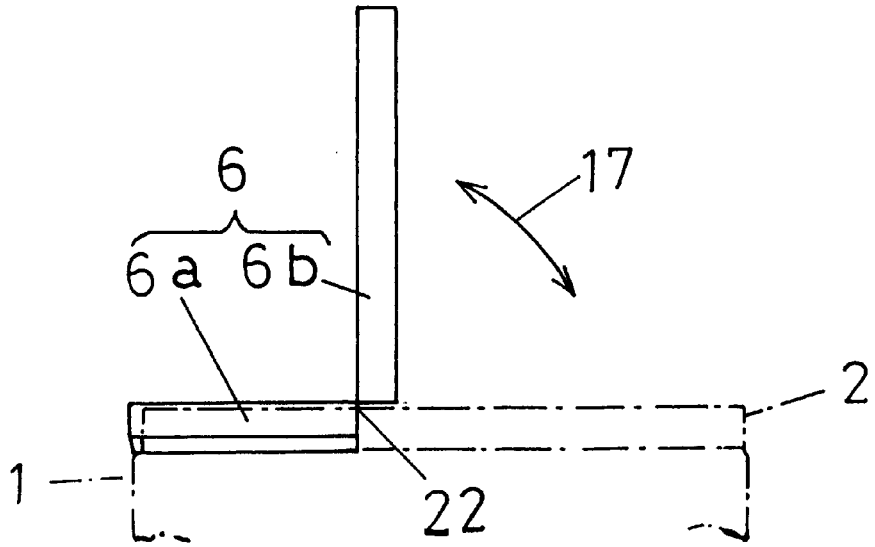
FIG. 7 is a side view of the can cover with the integral scraper, showing how the can cover is used.

When the sealing band 7 is removed, the peripheral wall 20 may be detached at each of the two weakened parts 23, 23 which correspond to respective ones of the opposite ends of the folding line 22 on the top plate portion 18*b*. Then, the cover portion 6*b* may be swung up or down along the folding line 22 to open or reclose the opening 2 as indicated by an arrow 17, with the cover portion 6*a* remaining mounted on the opening 2 (FIG. 7).

Swinging the cover portion 6*b* up to open the opening 2, with the can cover portion 6*a* mounted on the opening 2, allows the content to be taken out of the can shell by using a spoon or like. Any extra part of the content on the spoon may be removed by the scraper 19 on the underside of the top plate 18. As the scraper 19 is provided on the top plate 18 as an integral part thereof, there is no need of providing a separate scraper.

It should be noted that as the can cover portion 6*a* holds the opening 2 tightly by the cooperating action of the projection 21 and the annular projection 26 on the peripheral wall 20, the cover 6 cannot be removed from the opening 2 while the scraper 19 is being used.

In the embodiment shown and described, several projections 21, 21 are provided on the underside of the top plate 18*a* on the cover portion 6*a*, but a single elongated projection formed like an arc may also be provided, although it is not shown.

Although the present invention has been described by reference to the particular preferred embodiments thereof, it should be understood that various changes and modifications may be made without departing from the spirit and scope of the invention as defined in the appended claims.

What is claimed is:

1. A can cover comprising:

a top plate having a peripheral margin for attachment to a can, said top plate comprising a first part and a second part, said second part having a folding line that extends across said second part so that at least part of said second part can be folded upward relative to said first part, said folding line having opposite ends, and said first part having a top side and an underside;

a peripheral wall extending downwardly from said peripheral margin of said top plate, said peripheral wall including a thinner wall portion that extends horizontally along said peripheral wall intermediate said top plate and a lower end of said peripheral wall, a sealing band below said thinner wall portion, and frangible parts that extend vertically on said peripheral wall and which are located at positions corresponding to the opposite ends of said folding line; and a scraper extending downwardly from said underside of said first part, across said first part, and along said folding line.

2. The can cover of claim 1, wherein said scraper extends across said first part in a straight line.

3. The can cover of claim 1, wherein said first part of said top plate comprises at least one projection adjacent to said peripheral wall and extending downwardly from said underside of said first part so that a can top can be received between said peripheral wall and said at least one projection.

4. The can cover of claim 3, wherein said at least one projection comprises projections located at opposite ends of said scraper so that a can top can be received between said peripheral wall and said projections and so that said projections strengthen said scraper.

5. The can cover of claim 1, wherein said scraper has a straight edge bottom surface extending along a chord of said peripheral margin of said top plate.

6. A metallic can comprising:

a can shell having an opening on one end thereof, said can shell having an inner wall which integrally forms an annular flange extending radially inward at a position adjacent to said opening, said annular flange including upper and lower parts that extend horizontally and inwardly from said inner side wall toward the center of said can shell, said upper and lower parts having been pressed together and forming a U shape;

a can cover attached to said can shell to cover said opening, said can cover comprising a top plate having a peripheral margin attached to said can, said top plate comprising a first part and a second part, said second part having a folding line that extends across said second part so that at least part of said second part can be folded upward relative to said first part, said folding line having opposite ends, and said first part having a top side and an underside;

a peripheral wall extending downwardly from said peripheral margin of said top plate, said peripheral wall including a thinner wall portion that extends horizontally along said peripheral wall intermediate said top plate and a lower end of said peripheral wall, a sealing band below said thinner wall portion, and frangible parts that extend vertically on said peripheral wall and which are located at positions corresponding to the opposite ends of said folding line; and a scraper extending downwardly from said underside of said first part, across said first part, and along said folding line.

7. The metallic can of claim 6, wherein said scraper extends across said first part in a straight line.

8. The metallic can of claim 6, wherein said first part of said top plate comprises at least one projection adjacent to said peripheral wall and extending downwardly from said underside of said first part so that said can shell is received between said peripheral wall and said at least one projection.

9. The metallic can of claim 8, wherein said at least one projection comprises projections located at opposite ends of said scraper so that said can shell is received between said peripheral wall and said projections and so that said projections strengthen said scraper.

10. The metallic can cover of claim 6, wherein said scraper has a straight edge bottom surface extending along a chord of said peripheral margin of said top plate.

* * * * *